United States Patent [19]

Woolbright

[11] 4,101,028

[45] Jul. 18, 1978

[54] HERB CLEANER RECORD COVER

[76] Inventor: Marc Anthony Cantil Woolbright, 3927 Y St., Sacramento, Calif. 95817

[21] Appl. No.: 737,790

[22] Filed: Nov. 1, 1976

[51] Int. Cl.[2] ..... B65D 85/30

[52] U.S. Cl. ..... 206/311; 206/216; 209/126

[58] Field of Search ..... 206/216, 309–313, 206/315; 209/82, 126

[56] References Cited

U.S. PATENT DOCUMENTS

| | | | |
|---|---|---|---|
| 2,332,598 | 10/1943 | Proctor | 206/309 |
| 3,301,467 | 1/1967 | Shore | 206/312 |
| 3,747,756 | 7/1973 | Wheeler | 209/126 |

*Primary Examiner*—William Price
*Assistant Examiner*—Douglas B. Farrow

[57] ABSTRACT

The improvement of the standard double album cover enables the clean, orderly removal of impurities found in natural herbs, and gives a second utilitarian purpose to a record album cover, wherein a sifting device is formed on one side of the cover.

2 Claims, 4 Drawing Figures

HERB CLEANER RECORD COVER

This invention relates to record covers. It is particularly directed to the long playing record cover or the covers of 33 RPM records in as much as it can contain a standard 33 RPM record. I have found that record covers of the double album size are very helpful in the cleaning of natural herbs that have not been cleaned well enough, but as a standard record cover has no means of containment to prevent spillage and no means for convenient withdrawal of foreign matter found in many natural herbs.

In the following invention, I have altered the inside of a double album record cover to make a new system that enables a clean, quick and orderly cleaning process of herbs possible.

Said inside construction shall be made of cardboard that has been folded, bent, glued, and/or taped; it may also be molded from polyfoam, similar to the new egg carton, and the way they are formed.

Figure 1:
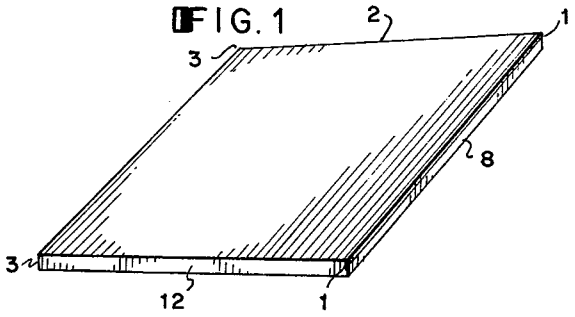
FIG. 1 is a view that shows the Herb Cleaner Record Cover in a closed position with one half inside and being contained by the half side shown.
Figure 2:
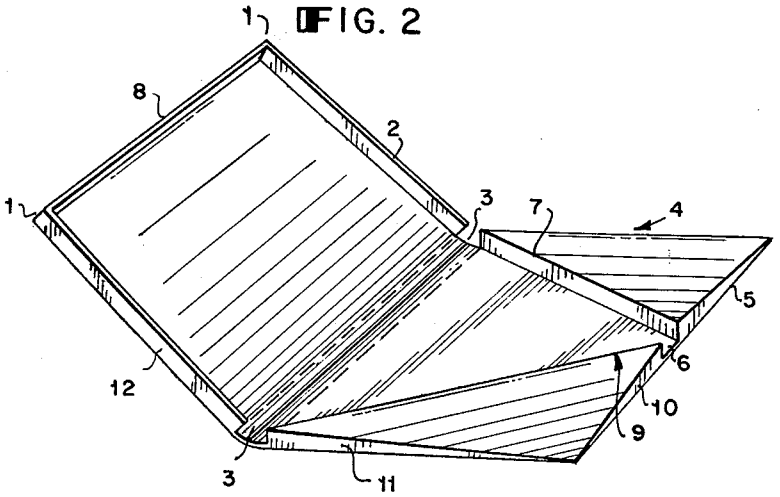
FIG. 2 is an open view with respect to operational positioning. The side previously contained within the square half is now outside of said half.
Figure 4:
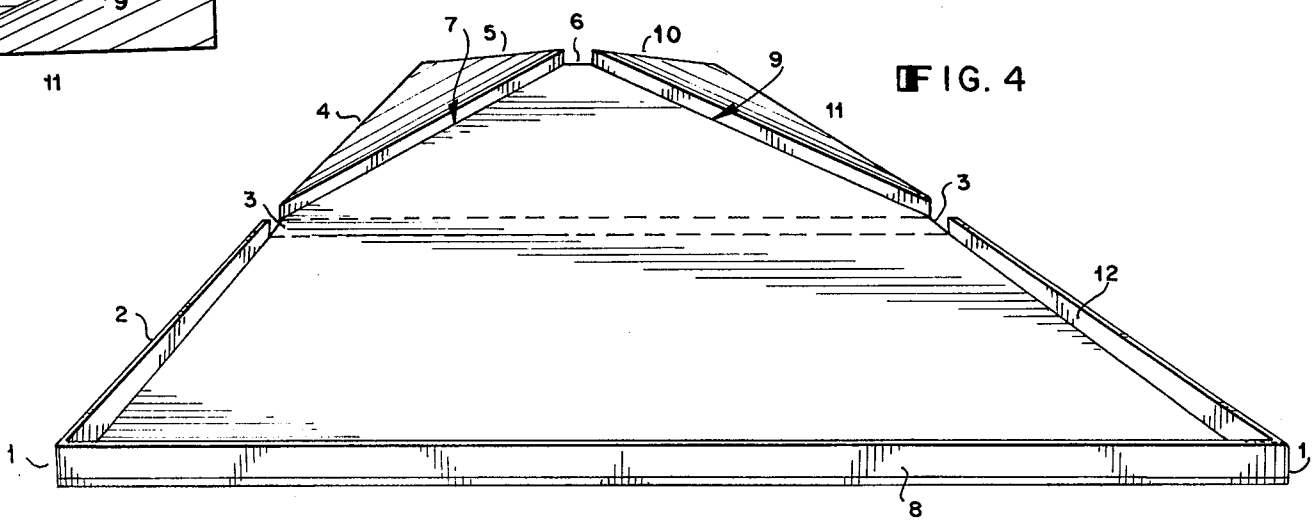
FIG. 4 is a level open view looking lengthwise to show a clear view of the opening where a 33 rpm record can be slid into and remain.
Figure 3:
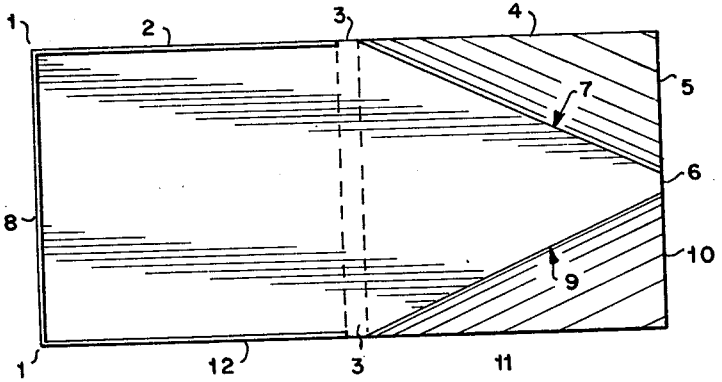
FIG. 3 is a view from directly above with the Herb Cleaner Record Cover when it is laying flat.

FIGS. 1 and 4 offer the best view of said opening in which a record can slip into, shown as a double line 1 and located on the edge running parallel with the side wall 8. Number 2 and 12 are walls that meet 8 to enclose the area of the half that is unobstructed and flat that when the Herb Cleaner Record Cover is folded into the closed position FIG. 1, the half side with 4, 5, and 6 which is the exit hole that is formed on this half by the convergence of the tapering walls 7 and 9 that start at the middle center 3 and end to form exit hole 6. FIG. 3 illustrates the rectangular full configuration.

The inside of the "Herb Cleaner Record Cover" will consist of two halves connected by a spine. The spine of the "Herb Cleaner Record Cover" will be clear of obstruction to permit the sliding and rolling of matter from one half of the cover to the other side. One side of the "Herb Cleaner Record Cover" is closed off at the outer three sides by an edge that projects $\frac{3}{8}$ of an inch on the perimeter to prevent spillage of herbs that are satisfactory to the operator or person doing the cleaning. These satisfactory herbs will remain there while the rest of the herbs are in the process of being cleaned. As undesired matter and foreign substances slide to the other half, they will be directed down a tapered "V" that remains opened at the bottom to permit the exit of the undesired material. The "V" shall be formed by the elevation of an inner edge that projects as the other edge does, but shall be located within the confines of the perimeter of this side. The "V" shall have it's widest side or opening at the middle center and it's small exit hole at the smaller end of the "V". The exit hole shall be no larger than two- and three-quarter inches, with the ideal size of the exit hole one inch wide.

The process of which herbs are cleaned stands basically in the operator using a card or the equivalent to shuffle the herbs inside the cleaner which is held at an angle such that the half with the closed-off side can contain the record that is also labeled 8 and 1 in the enclosed drawing is elevated higher than the side labeled with exit hole 6 in the drawing. Then by tapping and shuffling and permitting all the undesired substances to slide in the cleaner to the half that is labeled with exit hole 6 in the drawing, and held lower than the said half labeled 8 and 1, thus enabling any undesired substances to be directed out of said cleaner through exit hole located on edge marked with exit hole 6.

If and when the desired herbs start to fall towards the exit hole of the tapering edge, the cover may be closed and all herbs directed to spine (refer to label 3 in the drawing). Then the process may be resumed. To prevent satisfactory herbs from being lost, all desired herbs may be shuffled upwards to rest on the side with the closed-off edges to await use.

I claim:

1. In a double album record cover having two halves connected by a spine, the improvement comprising:

(a) one of said halves being formed with edge walls on the three edges of said half not adjacent said spine projecting normal to the plane of said one half and;

(b) the other of said halves having formed thereon a pair of converging walls forming a sorting device, said converging walls forming therebetween a converging sorting cavity having a wide end and a narrow end, the narrow end forming an exit opening, said wide end of said cavity being located at the edge of said other half adjacent said spine and the exit opening being located at the edge of said other half opposite said spine, said exit opening being less than $2\frac{3}{4}$ inches wide, whereby when said album is folded, said one half and said edge walls confine and enclose said sorting cavity, and said other half.

2. The album of claim 1 wherein said exit opening is substantially one inch wide.

* * * * *